United States Patent [19]

Uittenbogaard

[11] Patent Number: 4,491,368

[45] Date of Patent: Jan. 1, 1985

[54] METHOD FOR DREDGING ROCK WITH A PICK AND WATER JET COMBINATION

[75] Inventor: Robert E. Uittenbogaard, Reeuwijk, Netherlands

[73] Assignee: Stichting Speurwerk Baggertechniek, Netherlands

[21] Appl. No.: 604,437

[22] Filed: May 1, 1984

Related U.S. Application Data

[63] Continuation of Ser. No. 435,423, Oct. 20, 1982, abandoned.

[30] Foreign Application Priority Data

Oct. 22, 1981 [NL] Netherlands ..... 8104796

[51] Int. Cl.[3] ..... E21C 25/60

[52] U.S. Cl. ..... 299/17; 37/78

[58] Field of Search ..... 299/17; 37/61–63, 37/195, 1, 78

[56] References Cited

U.S. PATENT DOCUMENTS

| | | | |
|---|---|---|---|
| 2,678,203 | 5/1954 | Huff | 37/78 X |
| 3,402,487 | 9/1968 | Vaughan et al. | 37/78 |
| 4,004,358 | 1/1977 | Van Os | 37/63 |
| 4,193,635 | 3/1980 | Thiruvengadam et al. | 299/17 |
| 4,254,995 | 3/1981 | Guse et al. | 299/17 |
| 4,265,487 | 5/1981 | Barker | 299/17 X |
| 4,280,735 | 7/1981 | Lobbe | 299/17 X |

FOREIGN PATENT DOCUMENTS

| | | | |
|---|---|---|---|
| 29469 | 6/1981 | European Pat. Off. | 37/63 |
| 96070 | 11/1960 | Netherlands | 37/1 |
| 775245 | 10/1980 | U.S.S.R. | 37/63 |

*Primary Examiner*—Clifford D. Crowder
*Attorney, Agent, or Firm*—C. O. Marshall, Jr.

[57] ABSTRACT

A method for breaking out rock from a rock bottom under water, in which a cutting means having at least one pick is moved through the rock bottom. During the cutting procedure at least one water jet is directed from a nozzle towards the disintegrating zone in front of the pick rake surface and the starting energy of the jet is selected relative to the distance to be traversed through the water and relative to the nozzle diameter to such an extent that a cavitation cone forms around the water jet which continues up to the point where the jet hits the rock bottom.

4 Claims, 7 Drawing Figures

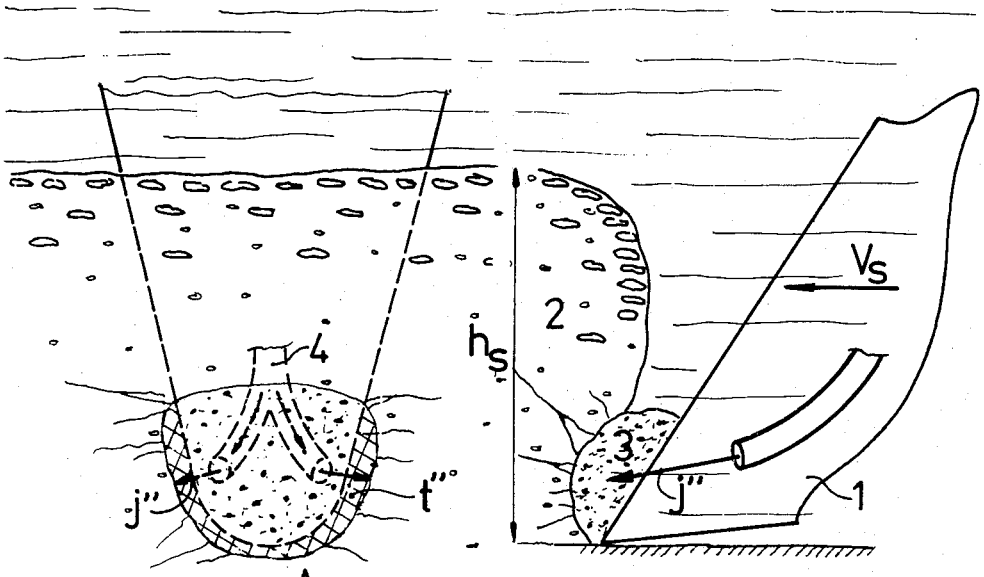
FIG 3A
FIG 3
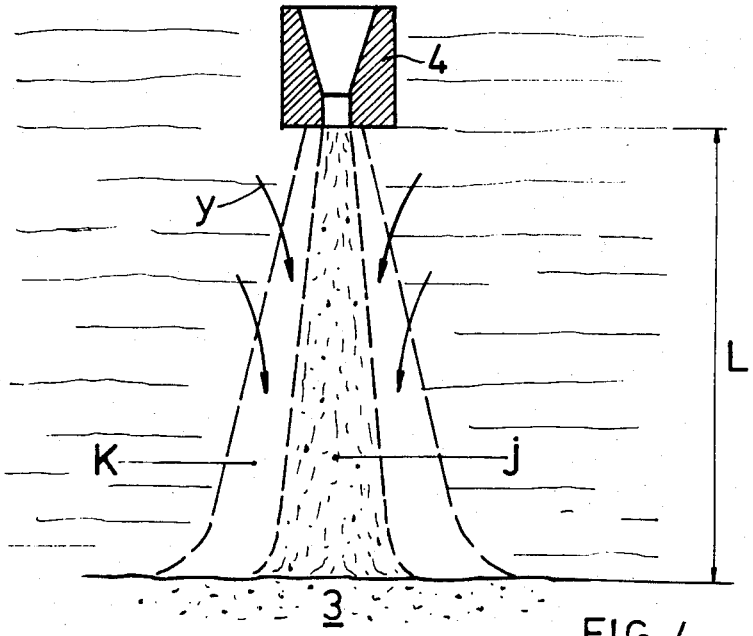
FIG. 4

METHOD FOR DREDGING ROCK WITH A PICK AND WATER JET COMBINATION

This is a continuation of application Ser. No. 435,423, filled 10-20-82, now abandoned.

The invention relates to a method for breaking out rock material from a submerged rock bottom by moving a cutting means having at least one pick through said rock bottom.

Such a method is known. The cutting means used therein comprises a rotating cutter having a plurality of helical blades together forming a crown like body, and with a plurality of picks mounted on each of said blades. In the field of the invention "dredging rock" means the cutting of rock material which is completely or substantially completely saturated with water and has a compression strength of 5 to 80 MPa using pick cutting speeds ranging from 1 and 5 m/s and cutting depths which may go up to the order of 100 mms.

The invention aims at improving the well-known method so as to reduce the mechanical power required for breaking loose a predetermined amount of rock per unit of time or, in other terms, to increase the amount of rock formation broken loose per unit of time while supplying the same mechanical power.

This purpose is achieved according to the invention in that during the cutting procedure at least one water jet is directed from a nozzle towards the disintegrating zone in front of the pick rake surface and the starting energy of the jet is selected relative to the distance to be traversed through the water and relative to the nozzle diameter, to such an extent that a cavitation cone forms around the water jet which continues up to the point where the jet hits the rock bottom.

One could have expected that the dampening action imparted by the surrounding water to the water jet would quickly reduce the jet and even very quickly in comparison with a jet directed in air. It was found, however, that by generating a cavitation cone this dampening action is considerably decreased so that the driving pressure is maintained up to a larger distance from the jet nozzle.

Further it was found that a powerful water jet, which could only slightly penetrate into the disintegrating zone with dry rock, may readily penetrate through said zone in case of water saturated rock, and so impart a weakening action on the groove wall forming around said zone due to which the cutting action of the cutting means is furthered. This is quite surprising in view of the relatively high cutting speeds, the relatively large cutting depths and the omnisided pressure prevailing in the disintegrating zone. Moreover, the tool life of the pick is thereby considerably increased.

Preferably the jet is directed to a flank of the groove forming in the rock formation. Experiments with a single pick have shown that with a thus directed water jet the breaking action in the transverse direction and therewith the quantity of rock broken out per unit of time is substantially improved. This means for a complete cutting head that adjacent picks will mutually support each other as to the breaking action in the transverse direction, more so than with the known method. The result is that the forces acting on the picks are finally reduced, or that the mutual pick spacing may be increased and less picks per cutting head blade will suffice, so that the total mechanical power which is to be supplied to the cutting head for the selected cutting velocity and cutting depth, is reduced.

According to a first practical embodiment a plurality of water jets are directed from above at short spacing from the rake surface of the pick, to the flanks of the forming groove. Therewith the water jets will not contact the pick.

In a second embodiment a plurality of water jets are directed from above along the pick rake surface, i.e. such that the jets hit the pick rake surface in a plurality of transversely spaced points at a height above the pick edge which is smaller than the height of the disintegrating zone. In this case influencing the disintegrating zone in front of the pick rake surface is simultaneously obtained by the water jets reflected from the pick rake surface.

In a third embodiment the water jets are supplied from the space behind the pick, i.e. such that they pass alongside the pick sides at short spacing and penetrate the disintegrating zone in front of the pick adjacent to the flanks of the forming groove.

The invention likewise relates to an apparatus for performing the described method, the apparatus being adapted for moving a cutting means having at least one pick under water through the rock bottom, said apparatus comprising according to the invention a nozzle device for issuing at least one water jet, the nozzle device being positioned relative to the pick such that the water jet hits the disintegrating zone forming during operation in front of the pick rake surface.

It is to be noted that breaking rock material from a rock surface mechanically and hydraulically, i.e. by applying a combination of a cutting means and one or more water jets, is known per se for digging tunnels. Therewith there has to be discerned between a method wherein the distance between the pick and the hitting point of the water jet(s) in the rock material situated in front of the pick is at least equal to the cutting depth of the pick, and a method wherein the water jets are directed against the rake surface or parallel to the rake surface of the pick at a spacing of only a few millimeters. In the first case a powerful water jet "cuts" a narrow slot in the rock in front of or beside the pick whereby extension of the cracks initiated by the pick and thereby breaking loose of larger rock pieces is furthered. In the second case the desintegrating zone situated in front of the rake surface of the moving cutting means is directly influenced by the water jets, namely by erosion and the building up of high water pressures in said zone, whereby so to speak a hydraulic splitting process takes place.

However, both cases relate to cutting dry, relatively strong rock in air, where the cutting depths and cutting velocities applied are in the order of ten times less than when dredging rock. Furthermore it is been noted that it is known in the art of oil drilling according to the U.S. Pat. No. 3,363,706 to use, when drilling holes under water, a drilling head together with water jets directed to the bottom of the drill hole.

The invention is hereunder further explained with reference to the drawing showing some embodiments given as examples.

FIG. 3 is a section taken in the direction of movement of a pick of an apparatus according to the invention in a third embodiment;

FIG. 3A is a view as seen from the left in FIG. 3, and

FIG. 4 shows schematically the shape of a water jet and its influence on the surrounding water.

Figure 1A:
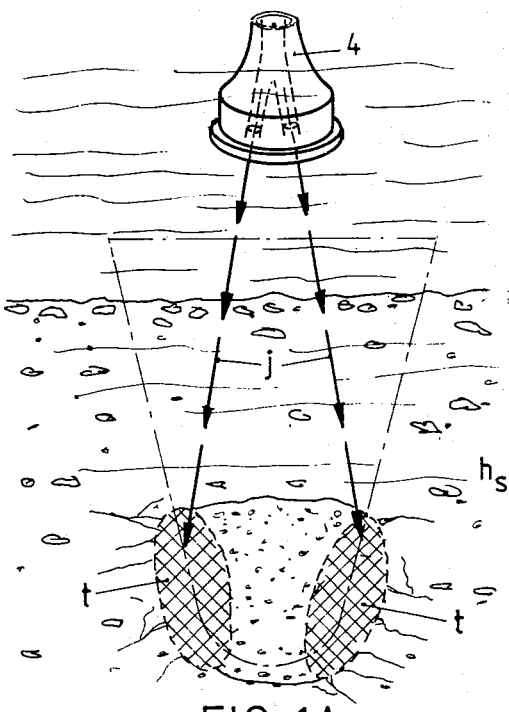
FIG. 1A is a view of the pick rake surface, as seen from the left in FIG. 1.
Figure 1:
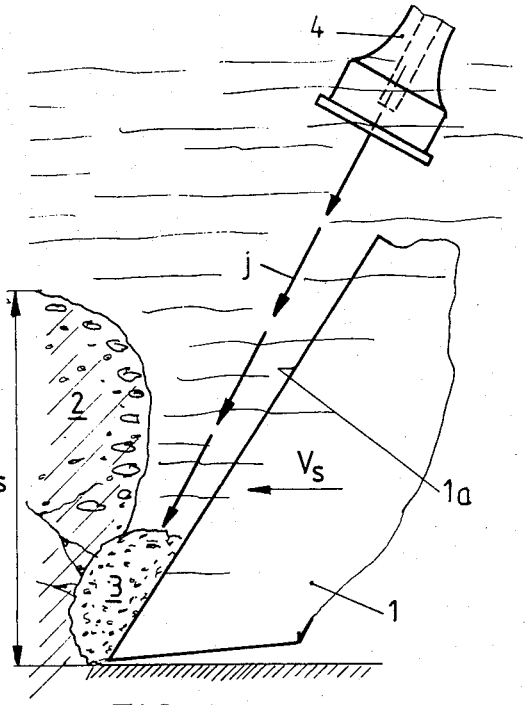
FIG. 1 shows a section taken in the direction of movement of a pick operating under water and belonging to an apparatus according to the invention, in a first embodiment.

In FIG. 1 a pick 1 is moved through a rock bottom 2 with a velocity $v_s$ of 1 to 5 meters per second. The pick 1 in practice is part of a group of picks provided in known manner on the blades of a cutting head or cutter. The cutting depth $h_s$ is e.g. 75 to 100 mms. As shown in the drawing a zone 3 forms in front of the rake surface 1*a* of the pick, adjacent to the pick edge, in which zone the rock formation is disintegrating, the height of said zone being e.g. 0.25 to 0.50 of the cutting depth.

Reference number 4 indicates a nozzle device which is secured in fixed position relative to the pick 1 and therefore moves together with the pick 1, said device issuing in the embodiment shown two water jets j which are directed at short spacing from and substantially parallel to the pick rake surface 1*a* of the disintegrating zone 3 and hit this zone in areas t (see FIG. 1A) situated in or adjacent to the flanks of the forming groove.

Figure 2A:
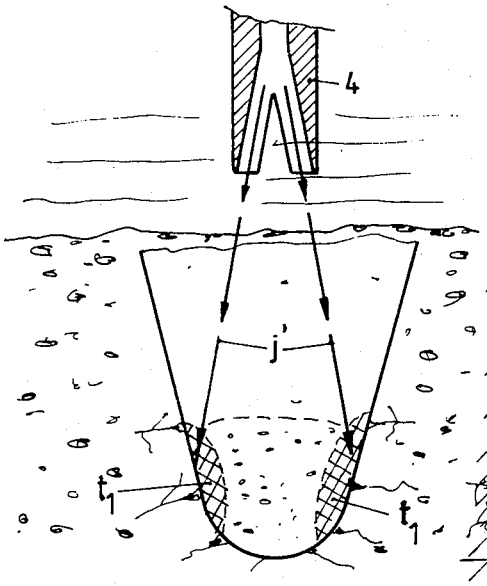
FIG. 2A shows a view seen from the left in FIG. 2.
Figure 2:
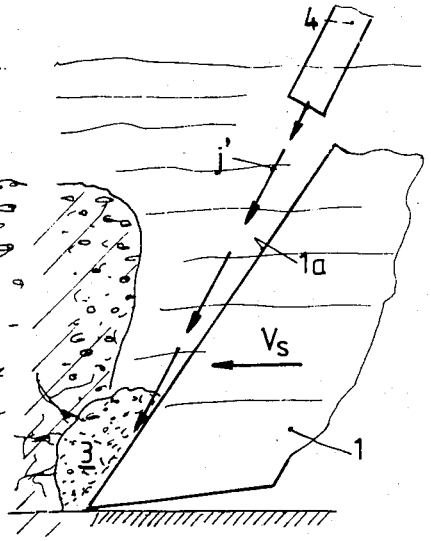
FIG. 2 is a section taken in the direction of movement of a pick of an apparatus according to the invention, in a second embodiment.

Starting from the areas t a splitting action on the adjacent rock formation takes place, said splitting action acting here particularly in the transverse direction. In the embodiment according to FIGS. 2 and 2A the nozzle device 4 is directed relative to the pick rake surface 1*a* such that the water jets j' hit this surface in the edge areas $t_1$. In this case also the jets reflected from the pick rake surface 1*a* (see particularly FIG. 2) establish an (increased) splitting action originating in the disintegrating zone 3.

In the embodiment according to FIGS. 3 and 3A the water jets j'' are supplied from behind and from the sides of the pick 1. They hit the disintegrating zone 3 in the edge areas t'' at the flanks of the forming groove. In this embodiment there is less possibility of damaging the nozzle device by rock that has been broken out.

In FIG. 4 in schematical manner the position of the nozzle 4 relative to the rock zone 3 to be hit is shown. The water jet j issued by the nozzle 4 covers a distance L through the surrounding water before it hits the rock zone 3. Thereby water is dragged along from the body of water surrounding the jet j according to the arrows y, whereby the jet loses part of its energy.

It has been established that if the energy inherent in the water jet j when leaving the nozzle 4 exceeds a predetermined threshold value a cone k forms around the water jet j, in which due to cavitation vapour is formed and which continues into the hitting point with the rock zone 3. Said cavitation cone constitutes an effective bar against excessive exchange of energy between the water jet and the surrounding water, so that a high driving pressure is ensured in the hitting point with the rock zone 3.

It was established during experiments in which a water jet j had a starting energy $P_j = \frac{1}{2}g.(v_j)^2$ of 24 $MJ/m^3$ that about 30% thereof was converted into driving pressure with L = 75 mm, an outlet diameter of the nozzle $d_j = 1.5$ mm and a water depth of about 1 m. Furthermore an increase of the percentage of the energy which was converted into driving pressure was established when the ratio $d_j$:L was increased.

I claim:

1. A method of breaking out rock from a rock bottom under water, comprising the step of driving a pick at a speed of 1 to 5 meters per second to cut a groove in the rock bottom, thereby causing to form in front of the pick, adjacent to the lower edge of the pick, a zone in which the rock is disintegrating, the height of said zone being from 25 to 50% of the height of the groove, wherein the improvement comprises the steps of directing at least one water jet so as to cause it to enter said zone at a point adjacent to one of the flanks of the groove, and controlling the starting energy of the jet to cause a cavitation cone to form around the jet and to extend to the point where the jet hits said zone, thereby shielding the jet against the dampening action of the surrounding water and maintaining a high driving pressure in the jet until it hits said zone.

2. A method according to claim 1 wherein two water jets are directed downward closely ahead of the pick, toward opposite flanks of the groove.

3. A method according to claim 2 wherein the water jets are so directed as to be deflected off the lateral front portions of the pick after entering the zone of disintegrating rock.

4. A method according to claim 1 wherein two water jets are directed forward along opposite sides of the pick.

* * * * *